US011148916B2

(12) United States Patent
Motoyama

(10) Patent No.: US 11,148,916 B2
(45) **Date of Patent: *Oct. 19, 2021**

(54) CONSTRUCTION MACHINE

(71) Applicant: KOBELCO CONSTRUCTION MACHINERY CO., LTD., Hiroshima (JP)

(72) Inventor: Yuudai Motoyama, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 149 days.

This patent is subject to a terminal disclaimer.

(21) Appl. No.: 16/481,981

(22) PCT Filed: Jan. 30, 2018

(86) PCT No.: PCT/JP2018/002972
§ 371 (c)(1),
(2) Date: Jul. 30, 2019

(87) PCT Pub. No.: WO2018/143197
PCT Pub. Date: Aug. 9, 2018

(65) Prior Publication Data

US 2019/0390440 A1 Dec. 26, 2019

(30) Foreign Application Priority Data

Feb. 2, 2017 (JP) ..... JP2017-017514
Jan. 11, 2018 (JP) ..... JP2018-002534

(51) Int. Cl.
*B66C 23/74* (2006.01)
*E02F 9/18* (2006.01)

(52) U.S. Cl.
CPC ..... *B66C 23/74* (2013.01); *E02F 9/18* (2013.01); *B66C 2700/0392* (2013.01)

(58) Field of Classification Search
CPC . B66C 23/72; B66C 23/74; B66C 2700/0392; B62D 49/085; E02F 9/18
See application file for complete search history.

(56) References Cited

U.S. PATENT DOCUMENTS 3,051,325 A * 8/1962 Risto ..... B66C 23/62 212/195
6,296,436 B1 10/2001 Ramun
(Continued)

FOREIGN PATENT DOCUMENTS

GB 2014537 A * 8/1979 ..... B66C 23/74
JP 2000-255986 A 9/2000
(Continued)

OTHER PUBLICATIONS

English translation of JP 2006-219241 (Year: 2021).*
(Continued)

*Primary Examiner* — Sang K Kim
*Assistant Examiner* — Nathaniel L Adams
(74) *Attorney, Agent, or Firm* — Oblon, McClelland, Maier & Neustadt, L.L.P.

(57) ABSTRACT

A construction machine improves ease of assembly of travelling body weights installed in a truck frame and allows a worker to easily move between one pair of side frames through the travelling body weights. The construction machine includes a lower travelling body of a crane includes a truck frame, a left side frame and a right side frame, and a front weight and a rear weight. The front weight and the rear weight each include a lower weight and an upper weight. An upper surface part of the upper weight extends continuously along a left and right direction, and a moving passage is formed between the one pair of side frames.

12 Claims, 13 Drawing Sheets

(56) References Cited

U.S. PATENT DOCUMENTS

| | | | | |
|---|---|---|---|---|
| 2016/0289047 | A1 | 10/2016 | Albinger et al. | |
| 2018/0022585 | A1* | 1/2018 | Miyazaki | B66C 23/76 212/305 |
| 2019/0367333 | A1* | 12/2019 | Maedo | B66C 9/10 |
| 2020/0039799 | A1* | 2/2020 | Motoyama | B66C 23/365 |
| 2020/0407200 | A1* | 12/2020 | Okubo | B66C 9/14 |

FOREIGN PATENT DOCUMENTS

| | | | |
|---|---|---|---|
| JP | 2001-171978 | A | 6/2001 |
| JP | 2004-203501 | A | 7/2004 |
| JP | 2006-219241 | A | 8/2006 |
| JP | 2012-111618 | A | 6/2012 |
| KR | 10-2014-0082937 | A | 7/2014 |
| WO | WO 2015/180007 | A1 | 12/2015 |

OTHER PUBLICATIONS

Extended European Search Report dated Jan. 7, 2020 in European Patent Application No. 18748783.8, 9 pages.

International Search Report dated Apr. 10, 2018 in PCT/JP2018/002972 filed Jan. 30, 2018.

* cited by examiner

CONSTRUCTION MACHINE

TECHNICAL FIELD

The present invention relates to a construction machine including one pair of left and right side frames.

BACKGROUND ART

Conventionally, as a mobile construction machine like a crawler crane, a construction machine including an upper slewing body and a lower travelling body is known. The lower travelling body includes a truck frame and one pair of left and right side frames coupled to the truck frame. The upper slewing body includes a work device and is supported by the truck frame of the lower travelling body in a slewable manner.

Patent Literature 1 discloses a technique in which a lower-weight is disposed between one pair of side frames in order to enhance stability of a machine body of a construction machine. In the technique, a truck frame includes a jackup cylinder and a jack beam supporting the jackup cylinder. The lower-weight is supported by the jack beam.

Also, the lower-weight includes a lower weight and one pair of upper weights. The one pair of upper weights is fixed to an upper surface part of the lower weight spaced apart from each other in a left and right direction. Both ends of the upper weight in a left and right direction are each disposed close to the one pair of side frames. As a result, a moving passage is formed between the one pair of side frames through the lower-weight.

CITATION LIST

Patent Literature

Patent Literature 1: Japanese Patent Application Laid-Open No. 2006-219241

In the technique described in Patent Literature 1, there is a step between the one pair of upper weights and the lower weight, and accordingly, the worker needs to move with attention to the step when the worker moves between the one pair of side frames. Also, in the above-described technique, one pair of upper weights is disposed at both ends of an upper surface part of the lower weight. Therefore, when the lower-weight is assembled, it is necessary to sequentially install the one pair of upper weights on the lower weight, and there is a problem that ease of assembly of the lower-weight deteriorates.

SUMMARY OF INVENTION

The present invention has been made in view of the above problem, and an object of the present invention is to provide a construction machine that allows a worker to easily move between one pair of side frames through a travelling body weight installed in a truck frame and can improve ease of assembly of a travelling body weight.

A construction machine is provided, and the construction machine includes: a lower travelling body configured to move on ground; and an upper slewing body supported by the lower travelling body in a slewable manner. The lower travelling body includes: a truck frame including a front surface part and a rear surface part, the truck frame supporting the upper slewing body; one pair of left and right side frames each supporting a crawler that allows circling movement, the one pair of left and right side frames being respectively coupled to both ends of a left and right direction of the truck frame to extend in a front and rear direction more than the truck frame; and one pair of front and rear travelling body weights respectively disposed on a front side and a rear side of the truck frame between the one pair of side frames. The truck frame includes frame side coupling parts disposed on the front surface part and the rear surface part, and coupled to the travelling body weights, each of the one pair of front and rear travelling body weights includes: a lower weight including a lower weight upper surface part, one pair of side surfaces disposed facing the one pair of side frames, and a weight side coupling part coupled to each of the frame side coupling parts; and an upper weight including an upper weight upper surface part and disposed above the lower weight upper surface part of the lower weight, both ends of the left and right direction of the upper weight extending to project to sides of the one pair of side frames more than the one pair of side surfaces of the lower weight. The upper weight upper surface part of the upper weight forms a moving passage extending continuously along the left and right direction between the both ends of the upper weight, the moving passage allowing movement by a worker between the one pair of side frames.

DESCRIPTION OF EMBODIMENTS

Figure 1:
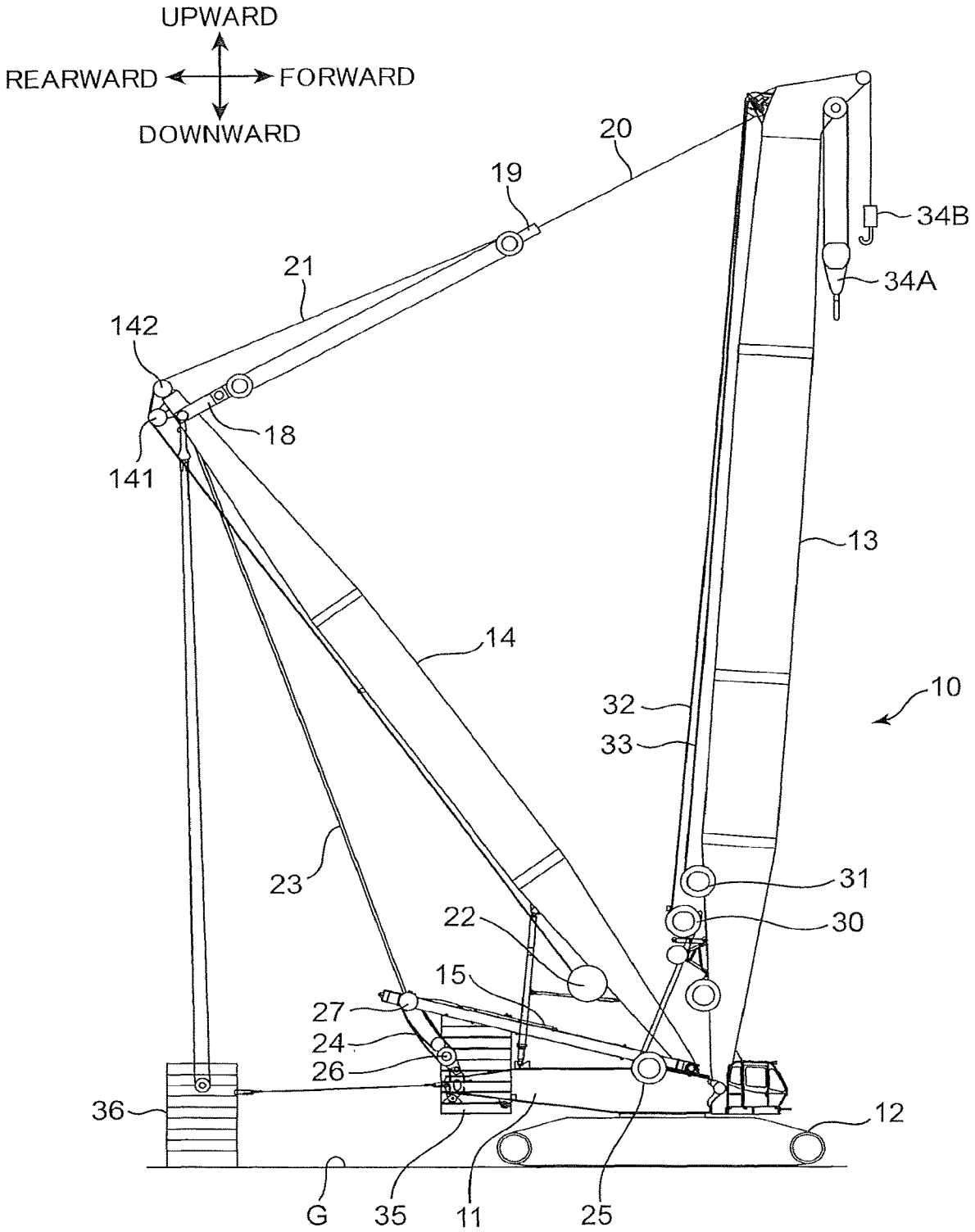
FIG. 1 is a side view of a construction machine according to a first embodiment of the present invention.

Embodiments of the present invention will be described below with reference to the drawings. FIG. 1 is a side view of a crane 10 (construction machine) according to a first embodiment of the present invention. Note that hereinafter, each figure shows directions of "upward", "downward", "leftward", "rightward", "forward", and "rearward", but these directions are shown for convenience for describing structure and a method of assembling the crane 10 according to the present embodiment, and do not limit the structure, the method of assembling, a usage mode, and the like of the construction machine according to the present invention.

The crane 10 includes an upper slewing body 11 corresponding to a crane body, a lower travelling body 12 that supports the upper slewing body 11 in a slewable manner and can travel on the ground, a boom 13 that functions as a derricking member, a lattice mast 14 that is a boom derricking member, and a box mast 15. Note that FIG. 1 illustrates the ground G.

The boom 13 is pivotably supported by the upper slewing body 11 to enable derricking around a horizontal axis. The lattice mast 14 is pivotally supported by the upper slewing body 11 around a pivotal axis parallel to a pivotal axis of the boom 13 at a rear position of the boom 13. The lattice mast 14 serves as a strut for pivoting the boom 13. The box mast 15 has a proximal end and a pivoting end (tip), and is pivotably coupled to the upper slewing body 11 on a rear side of the lattice mast 14. A pivotal axis of the box mast 15 is disposed parallel to the pivotal axis of the boom 13 at substantially the same position as the pivotal axis of the lattice mast 14.

Furthermore, the crane 10 includes a lower spreader 18, an upper spreader 19, a guy line 20, a boom derricking rope 21, and a boom derricking winch 22. The guy line 20 connects the upper spreader 19 to a tip of the boom 13. The boom derricking rope 21 is pulled out from the boom derricking winch 22, looped over a first mast sheave 141 and a second mast sheave 142 at a tip of the lattice mast 14, and then looped between a sheave block of the lower spreader 18 and a sheave block of the upper spreader 19 multiple times. The boom derricking winch 22 changes a distance between the sheave block of the lower spreader 18 and the sheave block of the upper spreader 19 by winding and delivering the boom derricking rope 21, and derricks the boom 13 while pivoting the boom 13 with respect to the lattice mast 14.

Furthermore, the crane 10 includes a guy line 23, a mast derricking rope 24, and a mast derricking winch 25. The guy line 23 connects the tip of the lattice mast 14 to a pivotal end of the box mast 15. The mast derricking rope 24 is looped multiple times between a sheave block 26 disposed in the upper slewing body 11 and a sheave block 27 disposed in the pivotal end of the box mast 15. The mast derricking winch 25 winds and delivers the mast derricking rope 24 and changes a distance between the sheave block 26 and the sheave block 27. As a result, while the box mast 15 and the lattice mast 14 pivot integrally with respect to the upper slewing body 11, the lattice mast 14 is derricked.

A main winding winch 30 and an auxiliary winding winch 31 for winding up and down loads are mounted on the crane 10. The main winding winch 30 winds up and down a load with a main winding rope 32. A main hook 34A for a load is coupled to the main winding rope 32 hanging down from the tip of the boom 13. When the main winding winch 30 winds and delivers the main winding rope 32, the main hook 34A is wound up and down. Similarly, the auxiliary winding winch 31 winds up and down a load with an auxiliary hook 34B connected to an auxiliary winding rope 33.

A counter weight 35 is mounted rearward of the upper slewing body 11 to adjust the balance of the crane 10. A pallet weight 36 is further disposed behind the upper slewing body 11.

Figure 2:
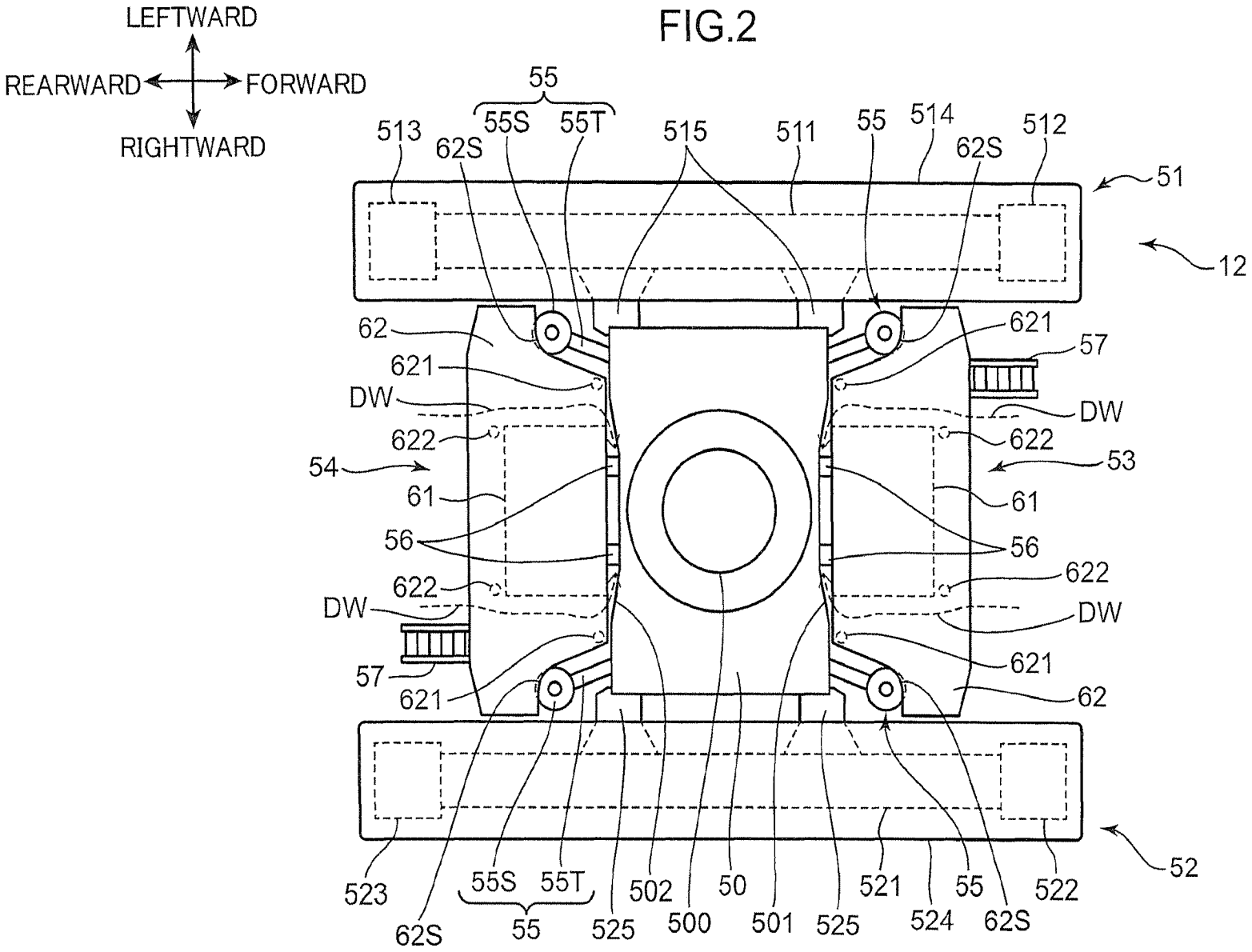
FIG. 2 is a plan view of a lower travelling body of the construction machine according to the first embodiment of the present invention.
Figure 3:
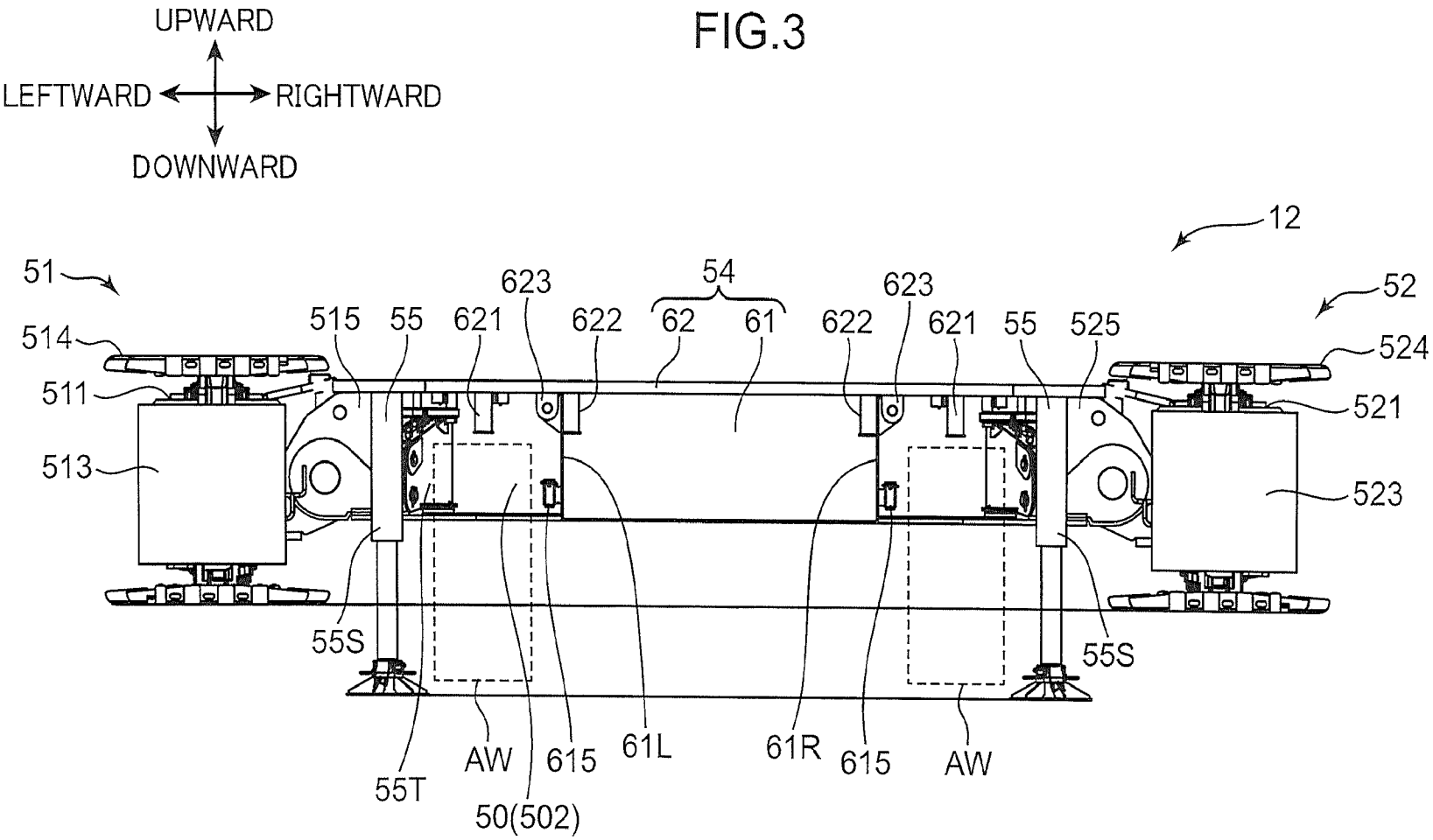
FIG. 3 is a rear view of the lower travelling body of the construction machine according to the first embodiment of the present invention.
Figure 4:
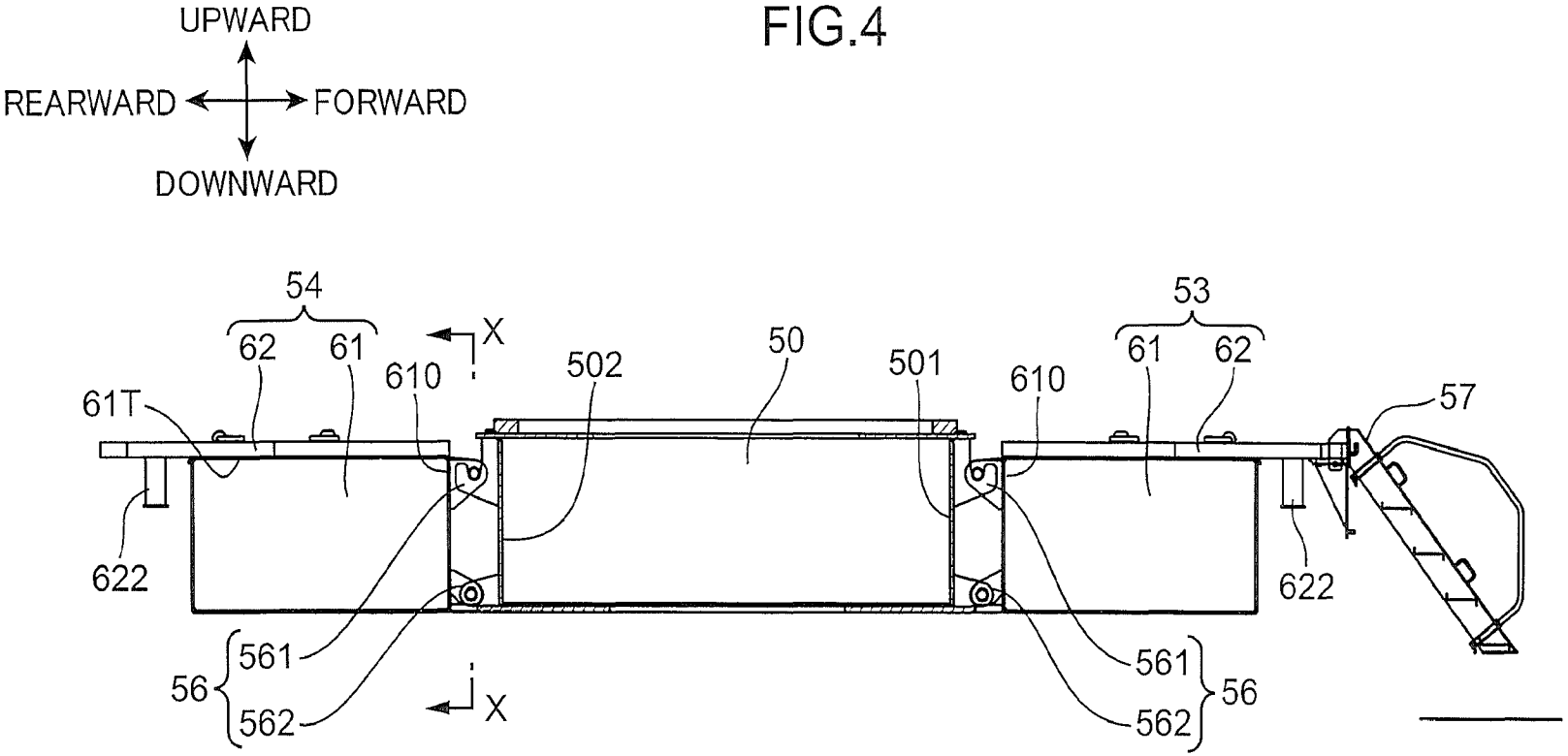
FIG. 4 is a side cross-sectional view of the lower travelling body of the construction machine according to the first embodiment of the present invention.

Next, structure of the lower travelling body 12 of the crane 10 according to the present embodiment will be described in more detail. FIG. 2 is a plan view of the lower travelling body 12 of the crane 10 according to the present embodiment. FIG. 3 is a rear view of the lower travelling body 12. Meanwhile, FIG. 4 is a side cross-sectional view of the lower travelling body 12.

The lower travelling body 12 includes a truck frame 50, a left crawler unit 51, a right crawler unit 52, a front weight 53 (travelling body weight), a rear weight 54 (travelling body weight), and a plurality of coupling parts 56.

The truck frame 50 is disposed in a central portion of the lower travelling body 12 and has a function to support the upper slewing body 11. The truck frame 50 has a generally rectangular shape including a front surface part 501 and a rear surface part 502. In addition, a slewing body axis support part 500 is disposed on an upper surface part of the truck frame 50. The upper slewing body 11 is installed in a slewable manner on the slewing body axis support part 500.

The left crawler unit 51 and the right crawler unit 52 are coupled to the left and right of the truck frame 50, respectively. The left crawler unit 51 includes a left side frame 511 (side frame), a left driving roller 512, a left driven roller 513, left crawler shoes 514 (crawler), and one pair of left frame coupling parts 515. Similarly, the right crawler unit 52 includes a right side frame 521 (side frame), a right driving roller 522, a right driven roller 523, right crawler shoes 524 (crawler), and one pair of right frame coupling parts 525.

The truck frame 50 further includes two pairs of front and rear jack up devices 55 provided on the front surface part 501 and the rear surface part 502, respectively.

The two pairs of front and rear jack up devices 55 have a function to support the lower travelling body 12. As shown in FIG. 2, these jack up devices 55 are disposed to project frontward and rearward from both ends of the front surface part 501 and the rear surface part 502, respectively. Note that the two pairs of jack up devices 55 on a front side and a rear side of the truck frame 50 are disposed at positions sandwiching an upper frame coupling part 503 and a lower frame coupling part 504 (FIG. 7), to be described later, from both sides of the left and right direction. Each jack up device 55 includes a jack up cylinder 55S and a jack up support member 55T for supporting the jack up cylinder 55S. The jack up cylinder 55S can expand and contract along the vertical direction by hydraulic pressure (see FIG. 3). An expansion operation of the plurality of jack up devices 55 allows the jack up devices 55 to support the lower travelling body 12 in a posture in which the left crawler unit 51 and the right crawler unit 52 are lifted from the ground. In this state, it is possible to install the left crawler shoes 514 and the right crawler shoes 524 in the left side frame 511 and the right side frame 521, respectively. Moreover, a platform of a transportation trailer (not shown) can enter below the lower travelling body 12 and load or unload the crane 10 on or from the transportation trailer.

The left side frame 511 and the right side frame 521 support the left crawler shoes 514 and the right crawler shoes 524 respectively so as to allow circling movement. The left side frame 511 and the right side frame 521 are respectively coupled to both ends of the left and right direction of the truck frame 50 through the left frame coupling parts 515 and the right frame coupling parts 525 so as to extend in a front and rear direction more than the truck frame 50. The left driving roller 512 and the right driving roller 522 are rotatably supported at front ends of the left side frame 511 and the right side frame 521 and drive the left crawler shoes 514 and the right crawler shoes 524, respectively, in response to driving force of a (not shown) driving mechanism. The left driven roller 513 and the right driven roller 523 are rotatably supported at rear ends of the left side frame 511 and the right side frame 521, respectively.

The front weight 53 and the rear weight 54 are disposed on a front side and a rear side of the truck frame 50, respectively, between the left side frame 511 and the right side frame 521. In more detail, the front weight 53 and the rear weight 54 are coupled to and supported by the front surface part 501 and the rear surface part 502 of the truck frame 50, respectively, between the left side frame 511 and the right side frame 521. These weights are installed in the truck frame 50 to maintain balance of the crane 10. The front weight 53 and the rear weight 54 are coupled to the truck frame 50 via the plurality of coupling parts 56 of FIG. 2. The coupling parts 56 each include an upper coupling part 561 and a lower coupling part 562 (see FIG. 5). Note that in other embodiments, the front weight 53 and the rear weight 54 may be coupled to the front surface part 501 and the rear surface part 502 of the truck frame 50 through other support members, respectively, between the left side frame 511 and the right side frame 521.

Figure 5:
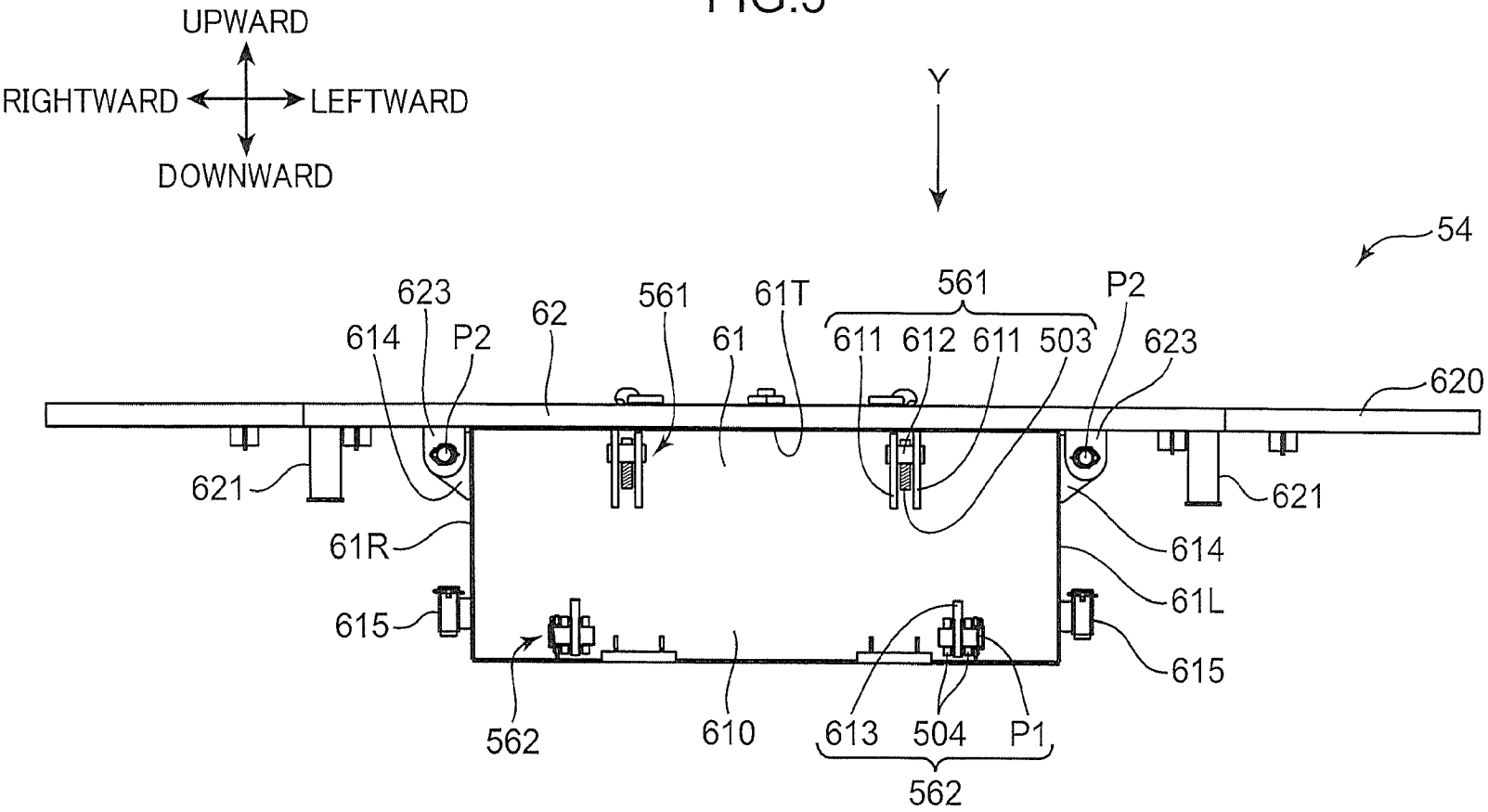
FIG. 5 is a cross-sectional view at an X-X position of the lower travelling body of FIG. 4.
Figure 6:
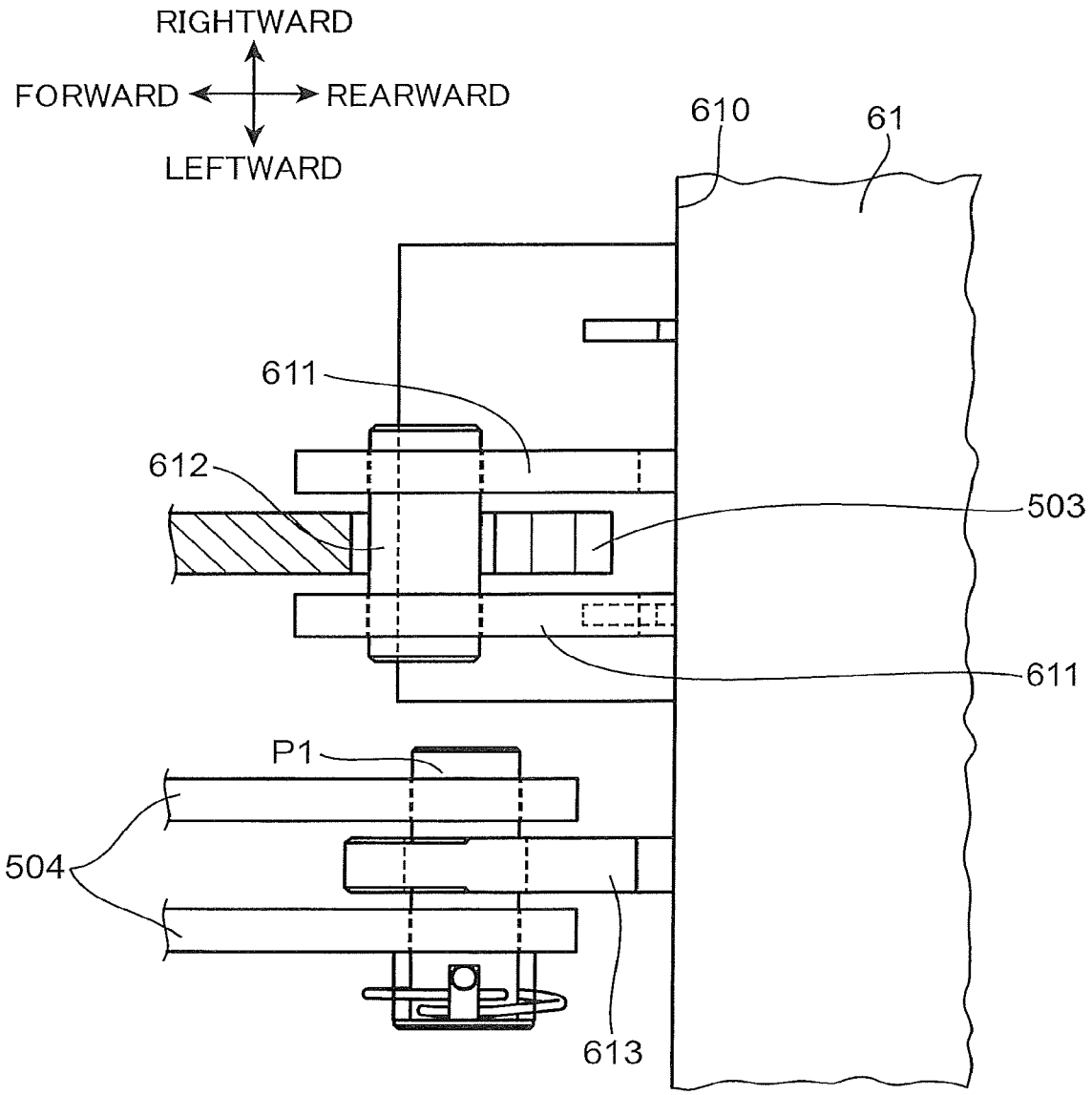
FIG. 6 is an enlarged plan view in which part of the lower travelling body of FIG. 5 is viewed from above.
Figure 7:
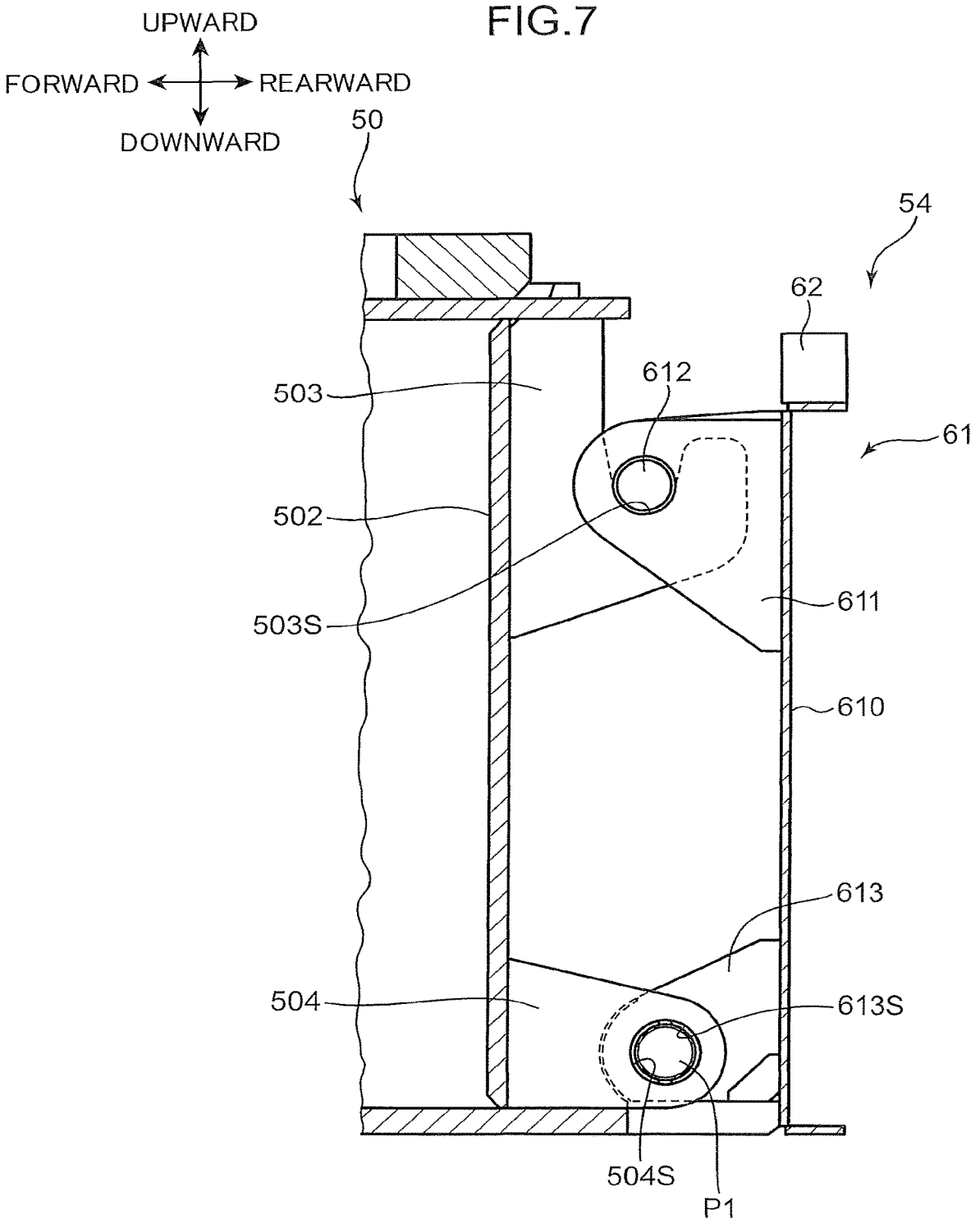
FIG. 7 is an enlarged cross-sectional view in which part of the lower travelling body of FIG. 4 is enlarged.

In the present embodiment, structure and coupling structure to the truck frame 50 are the same between the front weight 53 and the rear weight 54. Therefore, the following describes the structure of the rear weight 54 and the coupling structure of the rear weight 54 to the truck frame 50 as an example. FIG. 5 is a cross-sectional view at an X-X position of the lower travelling body 12 of FIG. 4 and corresponds to a view when the rear weight 54 is viewed from a truck frame 50 side. FIG. 6 is an enlarged plan view in which part of the lower travelling body 12 of FIG. 5 is viewed from above. FIG. 7 is an enlarged cross-sectional view in which part of the lower travelling body 12 of FIG. 4 is enlarged.

The rear weight 54 includes a lower weight 61, an upper weight 62, and a ladder 57.

The lower weight 61 is a heavy object having a generally rectangular shape. As shown in FIG. 2, the lower weight 61 is disposed at a position sandwiched by the one pair of jack up devices 55 from both sides of the left and right direction. The lower weight 61 includes a lower weight upper surface part 61T (FIG. 5), one pair of side surfaces (lower weight left side surface 61L and lower weight right side surface 61R: FIG. 5), and an opposite surface 610 (FIG. 4). The lower weight left side surface 61L and the lower weight right side surface 61R are disposed to face the left side frame 511 and the right side frame 521, respectively. The opposite surface 610 couples the lower weight left side surface 61L to the lower weight right side surface 61R in the left and right direction, and is disposed to face the rear surface part 502 of the truck frame 50 (FIG. 4).

The lower weight 61 further includes one pair of left and right upper weight coupling parts 611 (weight side coupling parts), one pair of left and right lower weight coupling parts 613 (weight side coupling parts), a plurality of lower weight connection plates 614 (FIG. 5), and one pair of left and right storage parts 615. The upper weight coupling parts 611 and the lower weight coupling parts 613 constitute the coupling parts 56 of the present embodiment (FIG. 2).

Each of the one pair of upper weight coupling parts 611 (FIGS. 5 and 7) is disposed to project from an upper end of the opposite surface 610 toward the truck frame 50. The one pair of upper weight coupling parts 611 is disposed spaced apart from each other in the left and right direction. Also, each upper weight coupling part 611 includes two plate-shaped parts and a shaft part 612 disposed to connect the two plate-shaped parts. The upper weight coupling part 611 is coupled to the upper frame coupling part 503 of the truck frame 50.

Each of the one pair of lower weight coupling parts 613 (FIGS. 5 and 7) is disposed to project from a lower end of the opposite surface 610 toward the truck frame 50. The one pair of lower weight coupling parts 613 is disposed spaced apart from each other in the left and right direction. Each lower weight coupling part 613 includes one plate-shaped part. Also, in the lower weight coupling part 613, a through hole 6135 (second through hole) is opened along the left and right direction (FIG. 7). The lower weight coupling part 613 is coupled to the lower frame coupling part 504 of the truck frame 50.

The plurality of lower weight connection plates 614 (FIG. 5) is disposed to project from upper ends of the lower weight left side surface 61L and the lower weight right side surface 61R along the left and right direction. Note that although not shown in FIG. 5, in each of the lower weight left side surface 61L and the lower weight right side surface 61R, the plurality of lower weight connection plates 614 is disposed spaced apart from each other in the front and rear direction. Each lower weight connection plate 614 is used to couple the lower weight 61 to the upper weight 62. In the lower weight connection plate 614, a through hole (not shown) is opened along the front and rear direction.

The one pair of left and right storage parts 615 (FIG. 5) is disposed in lower ends of the lower weight left side surface 61L and the lower weight right side surface 61R, respectively. Each storage part 615 has a cylindrical shape, an upper end of the storage part 615 is opened, and a lower end of the storage part 615 is blocked by a bottom. The storage part 615 can store a coupling pin P1 that couples the lower weight 61 to the truck frame 50. Therefore, in a state where the rear weight 54 is not coupled to the truck frame 50, the loss of the coupling pin P1 is prevented.

The upper weight 62 is a plate-shaped heavy object that is installed detachably from the lower weight 61 to be disposed above the lower weight upper surface part 61T of the lower weight 61. Since the rear weight 54 is configured in this way and two weights having lengths of the left and right direction different from each other can be separated, ease of transportation of the rear weight 54 improves. The upper weight 62 includes a plate-shaped part 620 extending along the left and right direction, one pair of first legs 621, and one pair of second legs 622. The plate-shaped part 620 is a body part of the upper weight 62 and is disposed above the lower weight upper surface part 61T. The plate-shaped part 620 has a substantially trapezoidal shape in top view, as shown in FIG. 2. In other words, the plate-shaped part 620 of the upper weight 62 has a substantially rectangular shape with two corners partially cut out. As a result, cutouts 62S are formed at two corners of the upper weight 62 facing the truck frame 50 to avoid the jack up devices 55. Meanwhile, the ladder 57 (FIGS. 2 and 4) can be installed in the upper weight 62, and enables the worker to move between the ground and an upper surface part of the upper weight 62.

The first legs 621 and the second legs 622 are disposed to project downward from a lower surface part of the plate-shaped part 620. The first legs 621 and the second legs 622 project at the same height from the plate-shaped part 620 to make it possible to support the plate-shaped part 620 at a predetermined height from the ground by bringing the upper weight 62 into contact with the ground when detached from the lower weight 61. As shown in FIG. 2, the one pair of first legs 621 projects from the plate-shaped part 620 at positions sandwiching the lower weight 61 from both sides of the left and right direction with a predetermined space near inner ends of the cutouts 62S. Meanwhile, the one pair of second legs 622 projects from the plate-shaped part 620 at positions rearward of the lower weight 61 to face both ends of the left and right direction of the lower weight 61. The four legs projected from the plate-shaped part 620 enable the upper weight 62 to be stably placed on the ground. As a result, even when the upper weight 62 is placed alone on the ground, the worker can access the lower surface part of the plate-shaped part 620.

Meanwhile, as shown in FIGS. 2 and 5, both ends of the left and right direction of the upper weight 62 extend to project on sides of the one pair of side frames (left side frame 511 and right side frame 521) more than one pair of side surfaces of the lower weight 61 (lower weight left side surface 61L and lower weight right side surface 61R). Furthermore, the upper surface part of the plate-shaped part 620 of the upper weight 62 (upper weight upper surface part) extends continuously along the left and right direction between both left and right ends. In other words, both ends of the left and right direction of the upper weight 62 are disposed close to the left side frame 511 and the right side frame 521 with a predetermined space. As a result, a moving passage is formed that allows the worker of the crane 10 to move between the one pair of side frames through the upper weight 62.

The upper weight 62 further includes a plurality of upper weight connection plates 623 (FIG. 5). The plurality of upper weight connection plates 623 is disposed to project downward from the lower surface part of the plate-shaped part 620 of the upper weight 62. Note that although not shown in FIG. 5, on each of the right side and the left side of the upper weight 62, the plurality of upper weight connection plates 623 is disposed spaced apart from each other in the front and rear direction. Also, as shown in FIG. 5, each upper weight connection plate 623 is disposed at a position overlapping the lower weight connection plate 614 of the lower weight 61 in the front and rear direction. The upper weight connection plates 623 are used to couple the lower weight 61 to the upper weight 62. In each upper weight connection plate 623, a through hole (not shown) is opened along the front and rear direction. Coupling pins P2 (FIG. 5) are sequentially inserted into the through hole of the lower weight connection plates 614 of the lower weight 61 and the through hole of the upper weight connection plates 623 of the upper weight 62, whereby the lower weight 61 and the upper weight 62 are coupled to each other on both left and right sides of the rear weight 54. Note that as shown in FIG. 5, the upper weight 62 can be easily disposed at an installation position with respect to the lower weight 61 because the left and right upper weight connection plates 623 are disposed at positions sandwiching the lower weight 61.

Meanwhile, the truck frame 50 further includes, provided on the rear surface part 502, one pair of upper frame coupling parts 503 (frame side coupling parts) (see FIG. 7) and one pair of lower frame coupling parts 504 (frame side coupling parts) (see FIG. 7). Note that the front surface part 501 of the truck frame 50 is also provided with similar coupling parts (FIG. 5). These coupling parts constitute the coupling parts 56 (FIG. 2) of the present embodiment.

Each of the one pair of upper frame coupling parts 503 is a plate-shaped part projecting toward the lower weight 61 from the upper end of the rear surface part 502 of the truck frame 50. The one pair of upper frame coupling parts 503 is disposed spaced apart from each other in the left and right direction. Each upper frame coupling part 503 includes one plate-shaped part. Also, as shown in FIG. 7, the upper frame coupling part 503 includes a groove part 503S. Since the shaft part 612 of the upper weight coupling part 611 is fitted into the groove part 503S, the upper weight coupling part 611 and the upper frame coupling part 503 are coupled to each other.

Similarly, each of the one pair of lower frame coupling parts 504 is a plate-shaped part projecting from the lower end of the rear surface part 502 of the truck frame 50. The one pair of lower frame coupling parts 504 is disposed spaced apart from each other in the left and right direction. Also, each lower frame coupling part 504 includes two plate-shaped parts. In each plate-shaped part, a through hole 504S (first through hole) is opened (FIG. 7). The lower frame coupling parts 504 are coupled to the lower weight coupling parts 613 of the lower weight 61.

When the rear weight 54 is coupled to the truck frame 50 of the lower travelling body 12, first, the upper weight 62 is installed in the lower weight 61 at a position away from the truck frame 50. The upper weight 62 lifted by an auxiliary crane (not shown) is placed on the lower weight upper surface part 61T of the lower weight 61, as shown in FIG. 5. Then, on both left and right sides of the lower weight 61, the coupling pins P2 are inserted into and fastened to the through holes of the lower weight connection plates 614 and the upper weight connection plates 623, whereby the rear weight 54 is assembled.

Subsequently, the auxiliary crane lifts and moves the rear weight 54 to be close to the rear surface part 502 of the truck frame 50. The shaft part 612 of the lower weight 61 (FIG. 7) is soon fitted into the groove part 503S of the upper frame coupling part 503 of the truck frame 50. Subsequently, the coupling pins P1 are inserted into and fastened to the through hole 6135 of the lower weight coupling part 613 and the through hole 504S of the lower frame coupling part 504, whereby the rear weight 54 is coupled to the truck frame 50 and the rear weight 54 is supported by the truck frame 50. Thus, in the present embodiment, the rear weight 54 and the truck frame 50 can be easily coupled to each other with the coupling pins P1.

When the rear weight 54 is coupled to the truck frame 50, as described above, the moving passage is formed that allows the worker to move between the one pair of side frames. This allows the worker to easily move between the one pair of side frames through the upper surface part of the upper weight 62 of the rear weight 54. Furthermore, the upper surface part of the upper weight 62 extends continuously along the left and right direction between both left and right ends of the upper weight 62. Therefore, movement of the worker is implemented more safely and easily and assembly of the rear weight 54 is implemented more easily than other configurations in which the upper weight 62 is divided. Note that the front weight 53 also produces a similar effect.

Furthermore, in the present embodiment, the lower weight 61 of the rear weight 54 is directly coupled to the rear surface part 502 of the truck frame 50. Therefore, as compared with other configurations in which the rear weight 54 is coupled to and supported by the jack up support members 55T of the jack up devices 55, the jack up devices 55 are not required in this configuration. Moreover, a decrease in ease of operation of the jack up devices 55 caused by installing the rear weight 54 in the jack up support members 55T is prevented.

Moreover, with reference to FIGS. 2 and 3, in the present embodiment, coupling passages AW (FIG. 3) are formed to allow the worker to easily access the coupling parts 56 (FIG.

2) from rearward of the rear weight 54. The coupling passages AW are formed along the front and rear direction below the upper weight 62 between the lower weight left side surface 61L of the upper weight 62 and the left jack up device 55, and between the lower weight right side surface 61R and the right jack up device 55. Moreover, in the present embodiment, in order to secure these coupling passages AW, the lower weight 61 is disposed at a position sandwiched by the one pair of left and right jack up devices 55 from both sides of the left and right direction. Meanwhile, one pair of left and right side surfaces of the lower weight 61 (lower weight left side surface 61L and lower weight right side surface 61R) is disposed spaced apart from the jack up devices 55 in the left and right direction. In other words, as shown in FIGS. 3 and 5, widths of the left and right direction of the lower weight 61 and the upper weight 62 are set to allow the rear weight 54 to have a T-shape that forms the coupling passages AW. Meanwhile, each of the lower weight left side surface 61L and the lower weight right side surface 61R of the lower weight 61 also has a function of defining one side part of each coupling passage AW. Therefore, the worker can easily reach the coupling parts 56 by travelling to the truck frame 50 side along the side surfaces of the lower weight 61.

Meanwhile, in the present embodiment, as shown in FIG. 2, the upper weight 62 includes the cutouts 62S to face the jack up devices 55. Therefore, expansion and contraction of the jack up cylinder 55S of the jack up device 55 is not prevented by the upper weight 62, and ease of operation of the jack up device 55 further improves.

Furthermore, in the present embodiment, the storage parts 615 are provided on the lower weight left side surface 61L and the lower weight right side surface 61R. This allows the worker to take out the coupling pins P1 from the storage parts 615 while entering the coupling passages AW. Note that the storage parts 615 may be provided on the rear surface part of the lower weight 61 (side surface on the front side of the sheet of FIG. 3). Also in this case, the worker can take out the coupling pins P1 from the storage parts 615, and can promptly reach the coupling parts 56 through the coupling passages AW.

Note that a shape of the storage part 615 is preferably set such that, when the coupling pin P1 is stored in the storage part 615, part of the coupling pin P1 is exposed from the storage part 615. In this case, by disposing the storage part 615 on any of the lower weight left side surface 61L, the lower weight right side surface 61R, and the rear surface part of the lower weight 61, the worker can easily check whether the coupling pin P1 has been installed in the coupling part 56 depending on whether the storage part 615 contains the coupling pin P1.

Also, in the present embodiment, as shown in FIGS. 2 and 4, the ladder 57 can be installed in the upper weight 62 of the rear weight 54 (front weight 53). Thus, the worker can move directly from the ground onto the upper weight 62. In other words, access from the ground to the upper weight 62, the left side frame 511, and the right side frame 521 is better than in other weight structure in which the worker moves from the ground onto the lower weight 61 and then moves from the lower weight 61 to the upper weight 62.

Figure 8:
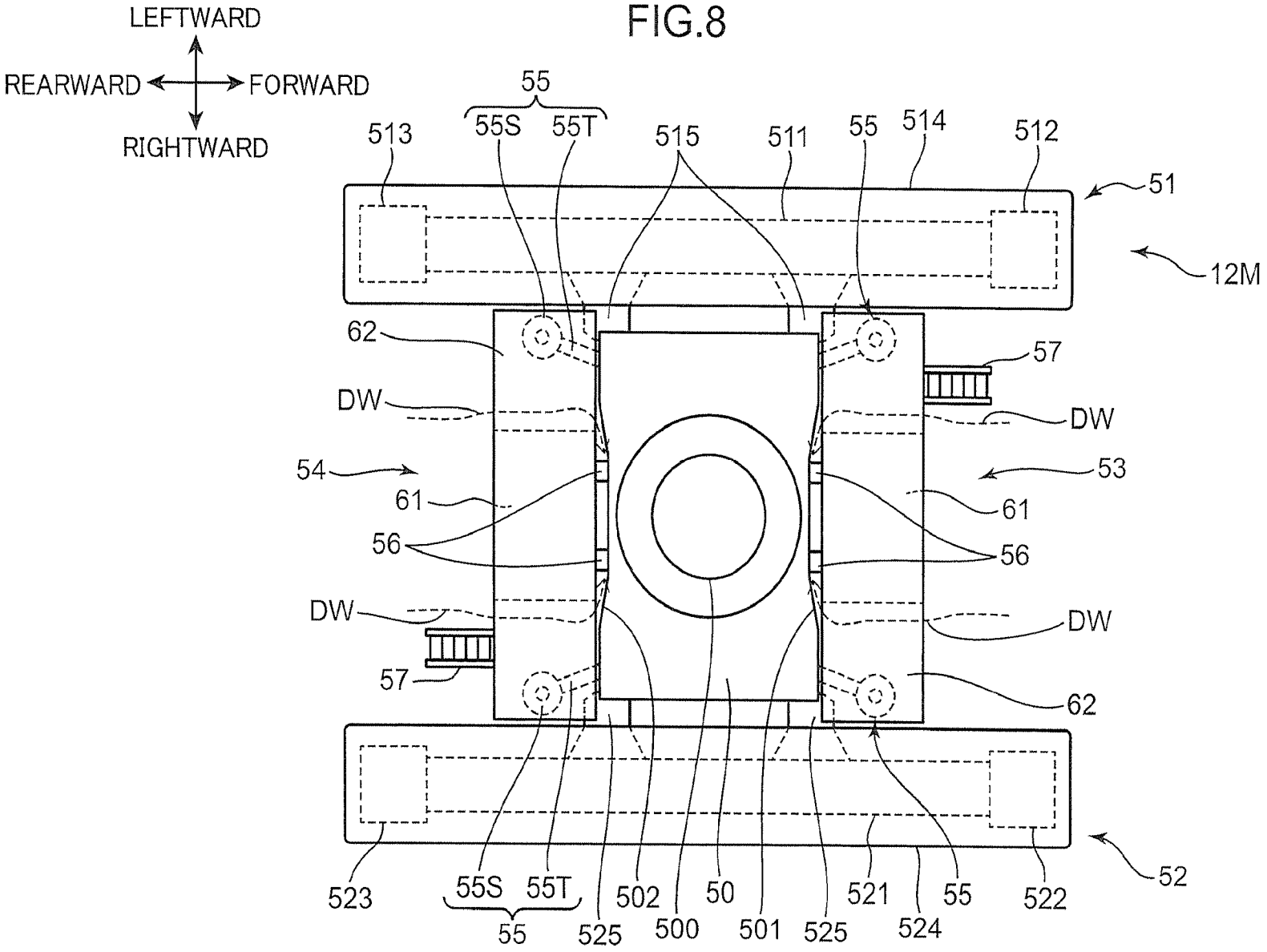
FIG. 8 is a plan view of a lower travelling body of a construction machine according to a second embodiment of the present invention.
Figure 9:
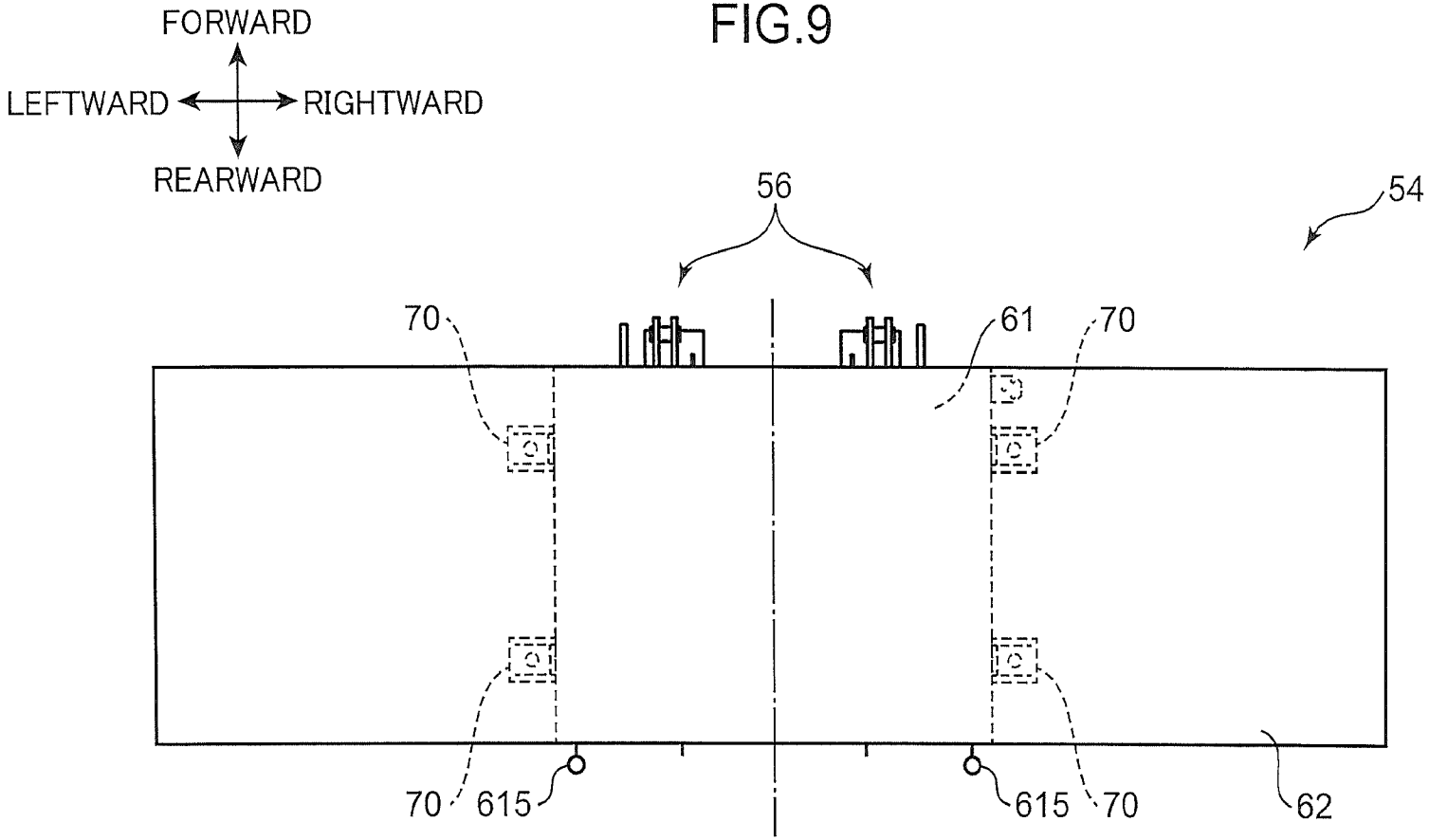
FIG. 9 is a plan view of a travelling body weight of the construction machine according to the second embodiment of the present invention.
Figure 10:
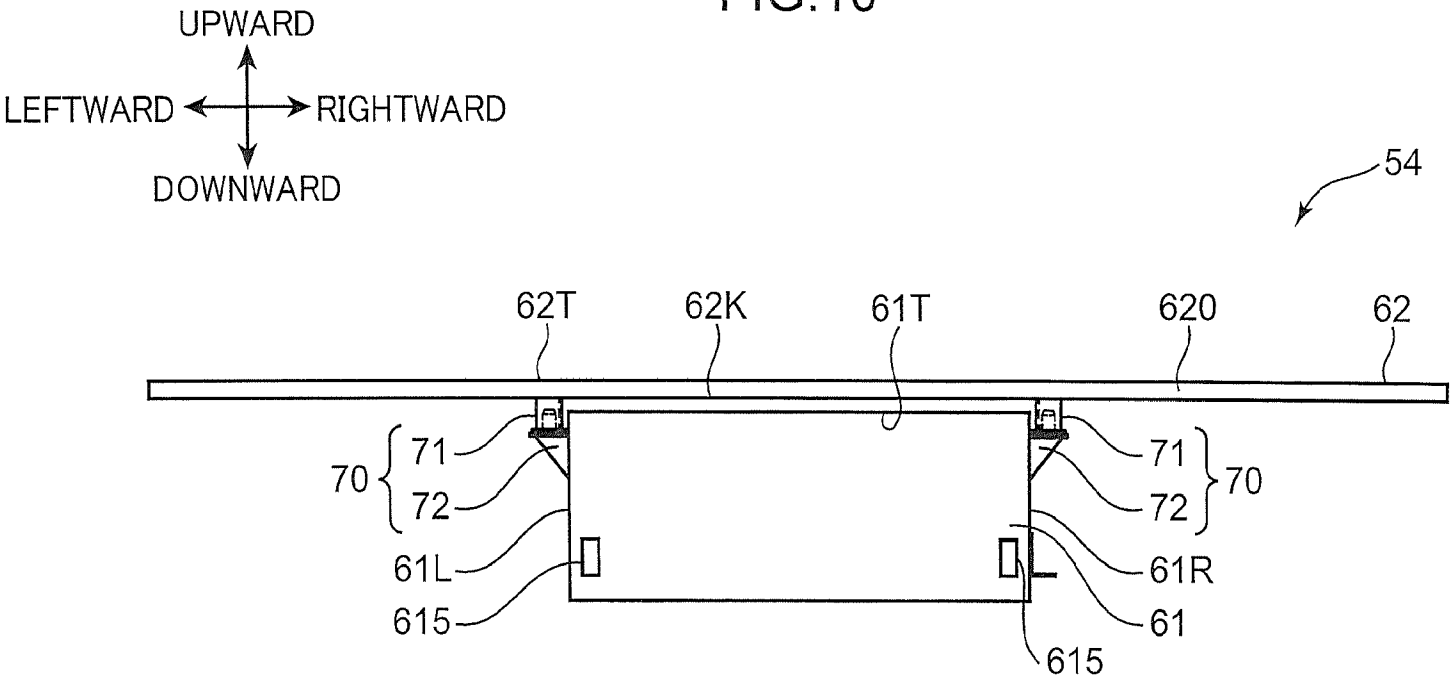
FIG. 10 is a rear view of the travelling body weight of the construction machine according to the second embodiment of the present invention.
Figure 11:
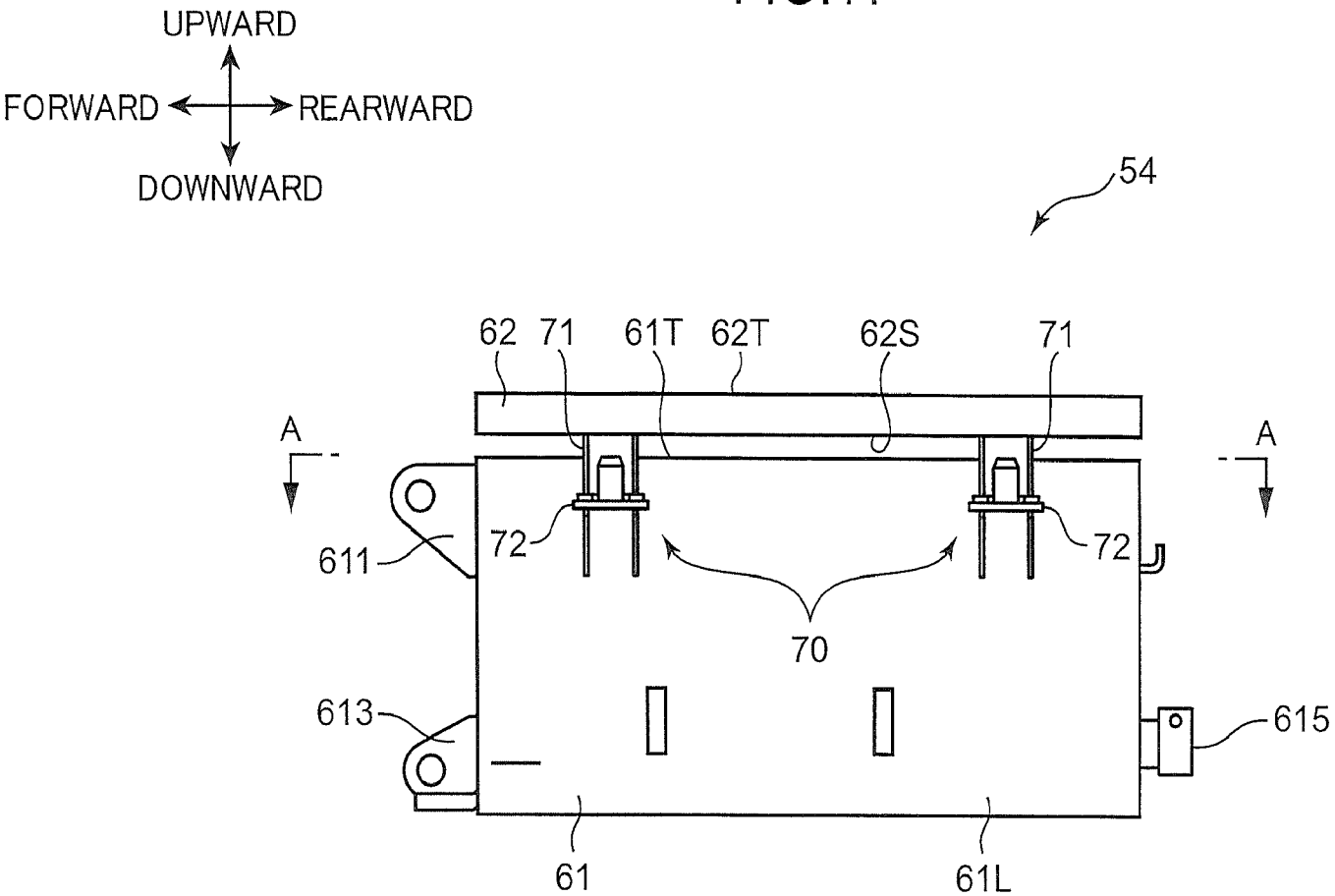
FIG. 11 is a side view of the travelling body weight of the construction machine according to the second embodiment of the present invention.
Figure 12:
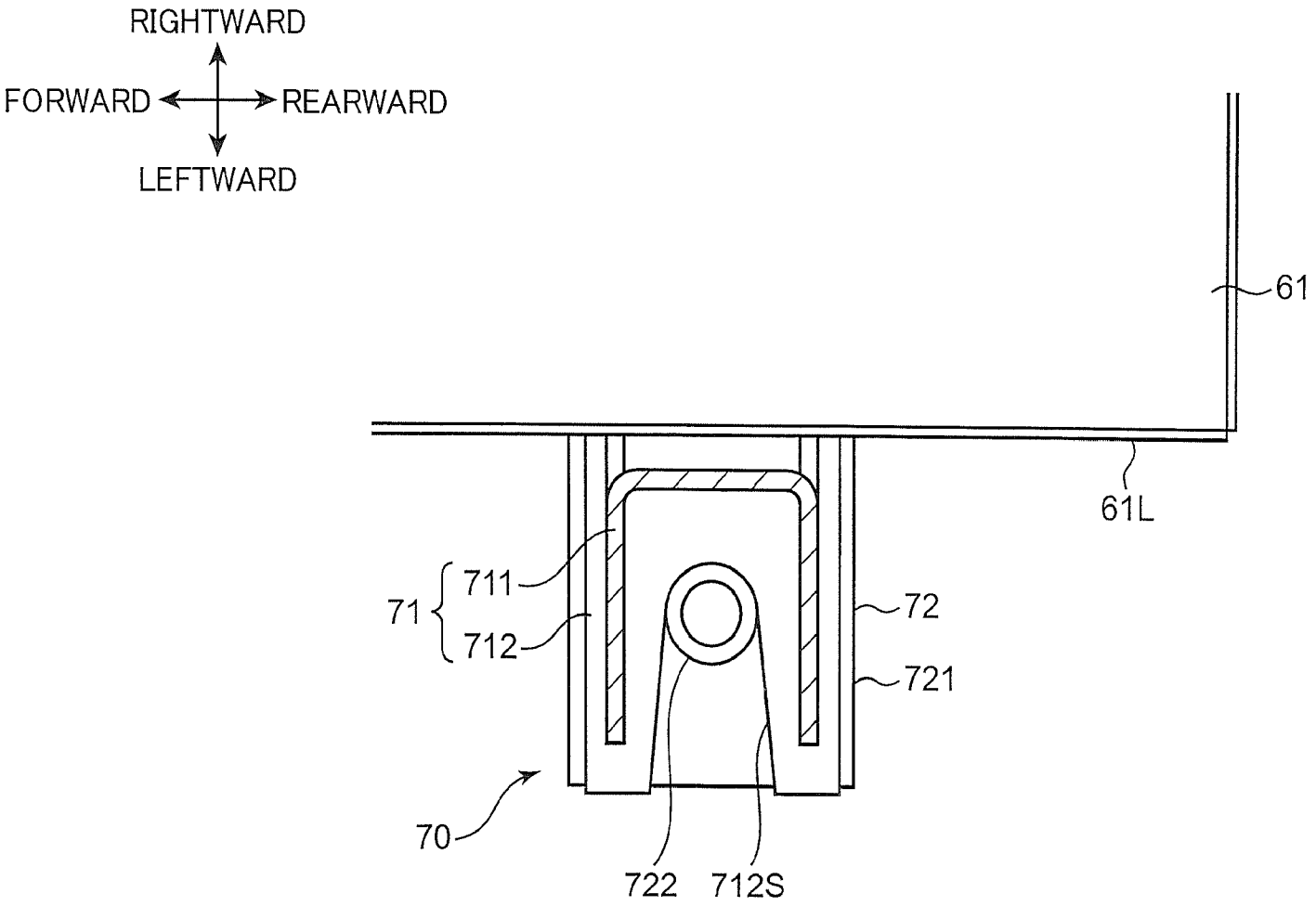
FIG. 12 is a cross-sectional view at an A-A position of the lower travelling body of FIG. 11.
Figure 13:
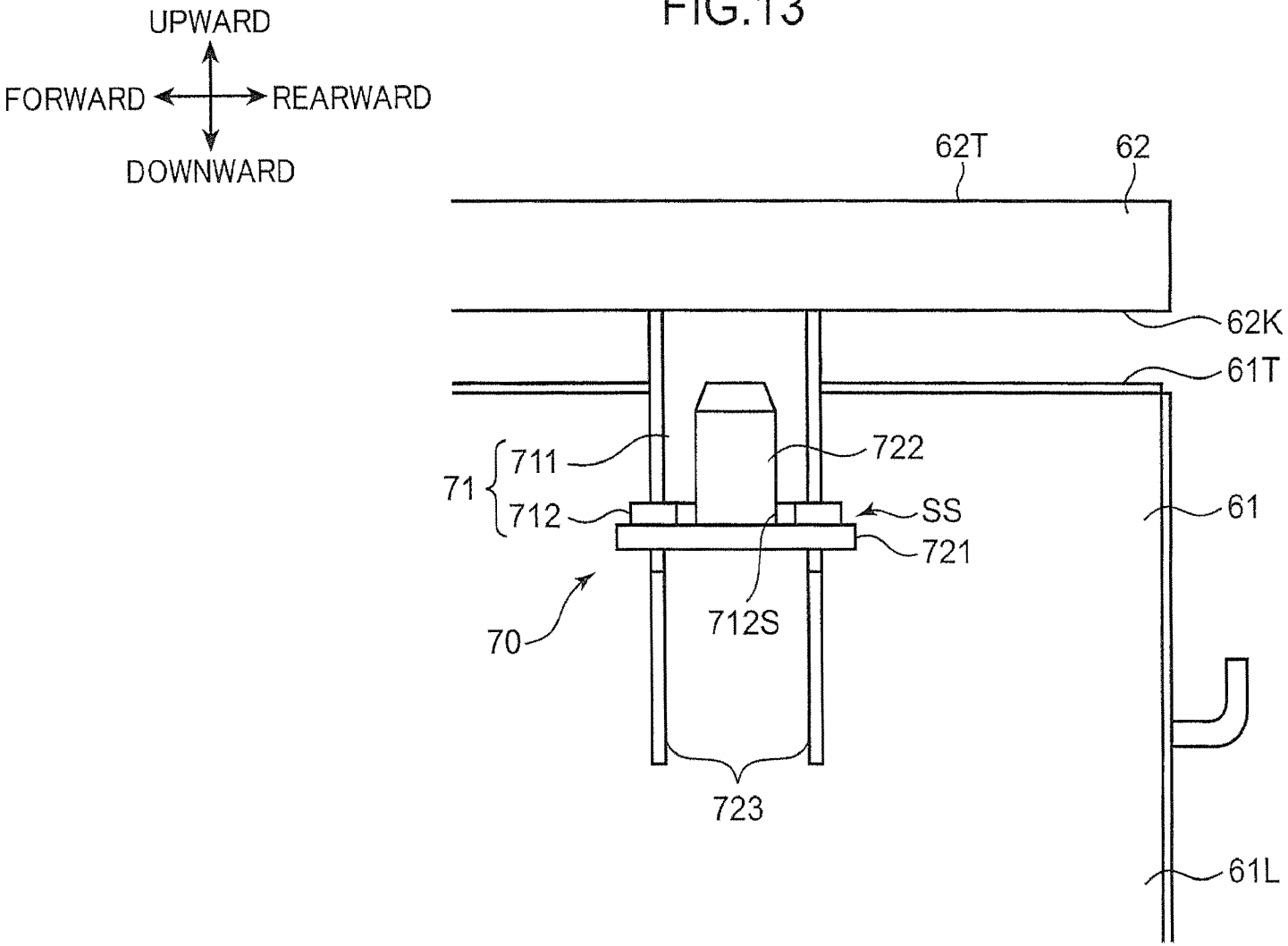
FIG. 13 is an enlarged side view in which one weight coupling part of one pair of weight coupling parts of FIG. 11 is enlarged.

Next, a crane (construction machine) according to a second embodiment of the present invention will be described. FIG. 8 is a plan view of a lower travelling body 12M of the crane according to the present embodiment. FIG. 9 is a plan view of a rear weight 54 (travelling body weight) of the crane according to the present embodiment. FIGS. 10 and 11 are a rear view and a side view of the rear weight 54 according to the present embodiment, respectively. FIG. 12 is a cross-sectional view at an A-A position of the lower travelling body 12M shown in FIG. 11, and is a view of a weight coupling part 70 to be described later as viewed from above. FIG. 13 is an enlarged side view in which one weight coupling part 70 of one pair of weight coupling parts 70 of FIG. 11 is enlarged. Note that in the present embodiment, in FIGS. 8 to 13, members having functions and structure common to members of the first embodiment are denoted with the same reference signs shown in FIGS. 1 to 12. The present embodiment, which differs from the first embodiment in coupling structure of an upper weight 62 to a lower weight 61, will mainly describe the difference and omit the description of other common points because the points are similar to those of the first embodiment.

With reference to FIG. 8, in the present embodiment, the upper weight 62 has a rectangular shape in top view, and forms a moving passage as in the first embodiment described above. In the present embodiment, cutouts 62S as shown in FIG. 2 are not formed in both left and right ends of the upper weight 62. That is, widths of a left and right direction of the upper weight 62 are set to be substantially the same along a front and rear direction.

Also, the upper weight 62 includes an upper weight upper surface part 62T and an upper weight lower surface part 62K (FIG. 10). The upper weight upper surface part 62T is an upper surface part of a plate-shaped part 620 of the upper weight 62, and the upper weight lower surface part 62K is a lower surface part of the plate-shaped part 620. That is, the upper weight lower surface part 62K is positioned below the upper weight upper surface part 62T. Also, as shown in FIGS. 10, 11, and 13, the upper weight lower surface part 62K is disposed spaced apart above the lower weight upper surface part 61T of the lower weight 61. To implement such a positional relationship, in the present embodiment, the rear weight 54 (front weight 53, travelling body weight) includes the plurality of weight coupling parts 70.

As shown in FIG. 9, as the plurality of weight coupling parts 70, in the present embodiment, two weight coupling parts 70 are disposed on each of left and right sides. Also, as shown in FIGS. 9 and 10, the two weight coupling parts 70 provided on the left side and the two weight coupling parts 70 provided on the right side are disposed to sandwich the lower weight 61 (lower weight upper surface part 61T) from both sides of the left and right direction. The plurality of weight coupling parts 70 couples the lower weight 61 to the upper weight 62 such that the upper weight lower surface part 62K is disposed spaced apart above the lower weight upper surface part 61T of the lower weight 61. Each weight coupling part 70 includes a coupling leg 71 and a support bracket 72.

The coupling leg 71 is disposed to project downward from the upper weight lower surface part 62K of the upper weight 62 (plate-shaped part 620). With reference to FIGS. 12 and 13, the coupling leg 71 includes a leg body 711 and an engagement plate 712. The leg body 711 is a columnar member projecting downward from the plate-shaped part 620, and has a substantial U-shape in horizontal cross-sectional view. The engagement plate 712 is a plate-shaped member fixed to a lower end of the leg body 711 and extending horizontally. As shown in FIG. 12, the engagement plate 712 has a substantial U-shape in top view to surround the leg body 711. In other words, a recess 712S is formed by cutting out a central portion of an outer edge of the left and right direction in a substantial U-shape from the rectangular plate-shaped member in top view. An engagement pin 722 to be described later can be inserted into the recess 712S.

The support bracket 72 is disposed on a lower weight left side surface 61L and a lower weight right side surface 61R (side surfaces) of the lower weight 61, and supports the coupling leg 71 at a position lower than the lower weight upper surface part 61T. The support bracket 72 includes a support plate 721, the engagement pin 722, and one pair of support ribs 723. The support plate 721 is a plate-shaped member projecting outward of the left and right direction from the lower weight left side surface 61L (lower weight right side surface 61R) of the lower weight 61, and extends horizontally. As shown in FIGS. 12 and 13, the support plate 721 has a function to support the engagement plate 712 of the coupling leg 71 from below, and has a rectangular shape slightly larger than the engagement plate 712. The engagement pin 722 is a pin disposed to extend upward from a substantially central portion of the support plate 721. As shown in FIG. 13, the tip (upper end) of the engagement pin 722 is tapered (taper shape). The one pair of support ribs 723 is fixed to the lower weight left side surface 61L (lower weight right side surface 61R) of the lower weight 61, and supports the support plate 721 from below.

In the present embodiment, an auxiliary crane (not shown) lifts the upper weight 62 above the lower weight 61, and the four coupling legs 71 are installed on the corresponding support brackets 72. At this time, since the recess 712S of the engagement plate 712 is fitted into the engagement pin 722, the position is restricted to the front and rear direction and the left and right direction of the upper weight 62. Also, since the four engagement plates 712 come into contact with the support plates 721 by the weight of the upper weight 62, the upper weight 62 is also positioned in a downward direction. As a result, as shown in FIGS. 10, 11, and 13, the upper weight lower surface part 62K of the upper weight 62 is disposed spaced apart above the lower weight upper surface part 61T of the lower weight 61. Note that structure to fix the upper weight 62 to the lower weight 61 is not limited to the above structure. The upper weight 62 may be fixed to the lower weight 61 with a bolt or other fixing members.

The front weight 53 and the rear weight 54, which are heavy objects with several tons to tens of tons in weight, have large surface areas as well. Therefore, to bring the lower weight upper surface part 61T of the lower weight 61 in close contact with the upper weight lower surface part 62K of the upper weight 62 as in the above embodiment, it is preferable to ensure the surface properties of the lower weight upper surface part 61T and the upper weight lower surface part 62K with high precision (machining). In other words, when the lower weight upper surface part 61T and the upper weight lower surface part 62K have unevenness, the upper weight 62 may be inclined or rattled. Meanwhile, in the present embodiment, as described above, since the upper weight lower surface part 62K and the lower weight upper surface part 61T do not come into close contact with each other, the need to process the surface properties of these surfaces with high precision is reduced. In other words, the upper weight 62 can be stably disposed on the lower weight 61 simply by securing the horizontally and surface properties of the four engagement plates 712 and the support plates 721 within a predetermined range.

Also, since the upper weight lower surface part 62K of the upper weight 62 is disposed spaced apart above the lower weight upper surface part 61T of the lower weight 61 in this way, the need to form the cutouts 62S as shown in FIG. 2 in the upper weight 62 is reduced. That is, the space between the upper weight lower surface part 62K and the lower weight upper surface part 61T is adjusted in advance such that the upper weight 62 is positioned above the uppermost position of jack up devices 55 (translifters) that is moved up and down by expansion and contraction by the hydraulic jack up cylinders 55S, whereby the upper weight 62 is always disposed to cover the jack up devices 55 from above. Therefore, even when the jack up devices 55 expand and contract up and down, the upper weight 62 is prevented from interfering with the expansion and contraction operation. Therefore, expansion and contraction strokes of the jack up devices 55 can be stably secured. Also, since the cutouts 62S do not need to be formed, both ends of the left and right direction of the upper weight 62 are disposed at positions near a left side frame 511 and a right side frame 521, and movement of the worker is implemented easily and safely. Furthermore, since weight of the upper weight 62 is not reduced due to provision of the cutouts 62S, decrease in suspension capability and stability of the crane 10 is prevented. In addition, manufacturing costs of the upper weight 62 for providing the cutouts 62S can be reduced.

Note that the position of the upper and lower direction of the upper weight 62 with respect to the lower weight 61 can be adjusted appropriately by inserting in advance a shim for height adjustment (plate-shaped member) between the engagement plate 712 and the support plate 721 (insertion portion SS in FIG. 13). Also, the shim can be used to further reduce the raffling of the upper weight 62. Moreover, the upper weight upper surface part 62T of the upper weight 62 and the upper surface part of the truck frame 50 are preferably set at substantially the same height (flush) by the position adjustment with such a shim and a shape of the weight coupling parts 70. In this case, movement by the worker between the upper weight 62 and the truck frame 50 is implemented easily and safely. Also, the upper weight upper surface part 62T of the upper weight 62 and upper surface parts of the left frame coupling parts 515 and the right frame coupling parts 525 may be set at substantially the same height. Even in this case, through the left frame coupling parts 515 and the right frame coupling parts 525, the worker can move easily and safely between the upper weight 62 and the left side frame 511, and between the upper weight 62 and the right side frame 521.

The crane 10 according to the embodiments of the present invention has been described above. Note that the present invention is not limited to these embodiments. As the construction machine according to the present invention, the following modified embodiments are possible.

(1) The above-described embodiments have been described using the crane 10 as a construction machine, but the present invention is not limited to these embodiments. The construction machine according to the present invention may be a machine of another aspect, such as a hydraulic excavator and an excavator.

(2) The first embodiment has been described in an aspect in which the storage parts 615 are disposed on the lower weight left side surface 611, and the lower weight right side surface 61R of the lower weight 61, but the storage parts 615 may be disposed on a surface of the rear weight 54 (front weight 53) opposite to an opposite surface 610 (see FIGS. 9 and 10). Also, the storage parts 615 may be disposed on the lower surface part of the upper weight 62 or the like.

(3) The embodiments have been described in an aspect in which the entire upper surface part of the upper weight 62 extends continuously between both ends, thereby forming the moving passage between the one pair of side frames.

However, the present invention is not limited to these embodiments. An aspect in which part of the front and rear direction of the upper surface part of the upper weight 62 extends continuously along the left and right direction between both ends of the left and right direction may be used. In addition, a plurality of grooves may be formed in the upper surface part of the upper weight 62 to prevent slippage in movement of the worker. Even in the above configuration, as compared with other configurations in which a plurality of upper weights 62 is divided and installed for the lower weight 61 and there is a step between the lower weight 61 and the upper weights 62, worker's movement can be implemented safely and easily.

(4) The second embodiment has been described in an aspect in which the upper weight 62 is supported by the four weight coupling parts 70 provided in the lower weight 61 and the upper weight 62. However, the present invention is not limited to this embodiment. The plurality of weight coupling parts according to the present invention may include truck frame side support parts disposed in the truck frame 50 and supporting the upper weight 62 from below. As one example, by providing the support brackets 72 of FIG. 10 on a front surface part 501 and a rear surface part 502 of the truck frame 50, the other coupling legs 71 disposed in the upper weight 62 may be supported by the support brackets 72. In this case, the upper weight 62 is supported by the truck frame 50 in addition to the lower weight 61. Therefore, stability of the upper weight 62 extending long in the left and right direction improves.

Auxiliary supports may be provided that support the upper weight 62 from below and are disposed in the plurality of left frame coupling parts 515 and the right frame coupling parts 525 respectively connecting the truck frame 50 to the left side frame 511 and the right side frame 521 (one pair of left and right side frames) (also referred to as inter-frame connection members or axle). As one example, the upper surface parts of the left frame coupling parts 515 and the right frame coupling parts 525 support the upper weight lower surface part 62K of the upper weight 62 as the auxiliary supports. Note that an aspect in which the coupling legs 71 provided in the upper weight 62 are supported by the left frame coupling parts 515 and the right frame coupling parts 525 may be used. Also in these cases, the upper weight 62 is supported by the left frame coupling parts 515 and the right frame coupling parts 525 in addition to the lower weight 61. Therefore, stability of the upper weight 62 extending long in the left and right direction similarly improves.

The present invention provides a construction machine, and the construction machine includes a lower travelling body configured to move on ground, and an upper slewing body supported by the lower travelling body in a slewable manner. The lower travelling body includes: a truck frame including a front surface part and a rear surface part, the truck frame supporting the upper slewing body; one pair of left and right side frames each supporting a crawler that allows circling movement, the one pair of left and right side frames being respectively coupled to both ends of a left and right direction of the truck frame to extend in a front and rear direction more than the truck frame; and one pair of front and rear travelling body weights respectively disposed on a front side and a rear side of the truck frame between the one pair of side frames. The truck frame includes frame side coupling parts disposed on the front surface part and the rear surface part, and coupled to the travelling body weights, each of the one pair of front and rear travelling body weights includes: a lower weight including a lower weight upper surface part, one pair of side surfaces disposed facing the one pair of side frames, and a weight side coupling part coupled to each of the frame side coupling parts; and an upper weight including an upper weight upper surface part and disposed above the lower weight upper surface part of the lower weight, both ends of the left and right direction of the upper weight extending to project to sides of the one pair of side frames more than the one pair of side surfaces of the lower weight. The upper weight upper surface part of the upper weight forms a moving passage extending continuously along the left and right direction between the both ends of the upper weight, the moving passage allowing movement by a worker between the one pair of side frames.

With this configuration, the moving passage is formed by the travelling body weights between the one pair of side frames. This allows the worker to easily move between the one pair of side frames through the upper weight upper surface part of the upper weight of the travelling body weight. In particular, the upper weight upper surface part extends continuously along the left and right direction between both ends of the upper weight. Therefore, as compared with other configurations in which the upper weight is divided, movement of the worker is implemented safely and easily, and assembly of the travelling body weight is implemented easily.

In the above configuration, preferably, the one pair of front and rear travelling body weights is respectively supported by the front surface part and the rear surface part of the truck frame between the one pair of side frames.

With this configuration, the one pair of front and rear travelling body weights can be stably supported by the truck frame.

In the above configuration, preferably, the truck frame further includes two pairs of front and rear jack up devices respectively disposed to project from the front surface part and the rear surface part at positions to sandwich the frame side coupling parts from both sides of the left and right direction, the two pairs of front and rear jack up devices configured to support the lower travelling body, the lower weight is disposed at a position sandwiched by one pair of the jack up devices of the two pairs of front and rear jack up devices from both sides of the left and right direction, and coupling passages that enable access to the frame side coupling parts and the weight side coupling parts from front or rear of the travelling body weights are formed along the front and rear direction below the upper weight and between the one pair of side surfaces of the lower weight and the one pair of jack up devices, by disposing the one pair of side surfaces of the lower weight spaced apart from the one pair of jack up devices in the left and right direction.

With this configuration, the worker can access the frame side coupling parts and the weight side coupling parts from front or rear of the travelling body weights through the coupling passages. Therefore, in the configuration in which the travelling body weight is coupled to the front surface part or the rear surface part of the truck frame, a coupling operation of both parts can be easily implemented.

In the above configuration, preferably, the upper weight is detachable with respect to the lower weight.

With this configuration, by separating two weights having different lengths in the left and right direction, ease of transportation of the travelling body weight improves.

In the above configuration, preferably, the upper weight includes: a plate-shaped part extending along the left and right direction and disposed above the lower weight upper surface part of the lower weight; and a plurality of legs disposed to project downward from a lower surface part of the plate-shaped part, the legs being configured to support the plate-shaped part at a predetermined height with respect to the ground by coming into contact with the ground when the upper weight is detached from the lower weight.

With this configuration, even when the upper weight is detached from the lower weight, the upper weight can be stably placed on the ground. Also, when the upper weight is placed on the ground, it is possible to access the lower surface part of the plate-shaped part of the upper weight.

In the above configuration, preferably, the upper weight includes an upper weight lower surface part positioned below the upper weight upper surface part, and the construction machine further includes a plurality of weight coupling parts that couples the upper weight to the lower weight such that the upper weight lower surface part is disposed spaced apart above the lower weight upper surface part.

With this configuration, the upper weight lower surface part is disposed spaced apart above the lower weight upper surface part. Therefore, the upper weight lower surface part and the lower weight upper surface part do not come into close contact with each other, and thus the need to process the surface properties of these surfaces with high precision is reduced.

In the above configuration, preferably, the plurality of weight coupling parts is disposed to sandwich the lower weight from both sides of the left and right direction, each of the plurality of weight coupling parts includes: a coupling leg disposed to project downward from the upper weight lower surface part; and a lower weight side support bracket disposed on each of the side surfaces of the lower weight and supporting the coupling leg at a position lower than the lower weight upper surface part.

With this configuration, the upper weight lower surface part can be disposed spaced apart above the lower weight upper surface part by using the coupling legs disposed in the upper weight and the lower weight side support bracket disposed in the lower weight.

In the above configuration, preferably, the plurality of weight coupling parts includes truck frame side support parts disposed in the truck frame and supporting the upper weight from below.

With this configuration, the upper weight is supported by the truck frame in addition to the lower weight. This improves stability of the upper weight extending long in the left and right direction.

Preferably, the above configuration further includes a plurality of inter-frame connection members connecting the truck frame to the one pair of left and right side frames, and the plurality of weight coupling parts includes auxiliary supports disposed in the plurality of inter-frame connection members and supporting the upper weight from below.

With this configuration, the upper weight is supported by the inter-frame connection members in addition to the lower weight. This improves stability of the upper weight extending long in the left and right direction.

In the above configuration, preferably, the truck frame further includes a plurality of jack up devices disposed to project from the front surface part and the rear surface part at positions to sandwich the frame side coupling parts from both sides of the left and right direction, the plurality of jack up devices configured to support the lower travelling body, and the upper weight is disposed to cover the plurality of jack up devices from above.

With this configuration, the need to bypass an area around the jack up devices is reduced when the worker moves through the moving passage. In addition, by adjusting in advance the space between the upper weight lower surface part and the lower weight upper surface part, it is possible to prevent the upper weight from interfering with the expansion and contraction operation even when the jack up devices expand and contract up and down.

In the configuration, preferably, first through holes are opened along the left and right direction in the frame side coupling parts, second through holes are opened along the left and right direction in the weight side coupling parts, and the lower travelling body further includes coupling pins to be inserted into the first through holes and the second through holes, the coupling pins coupling the travelling body weights and the truck frame to each other.

With this configuration, it is possible to easily couple the travelling body weights to the truck frame with the coupling pins.

In the configuration, preferably, the travelling body weights include storage parts configured to store the coupling pins.

With this configuration, the loss of the coupling pins is prevented with the travelling body weights being not coupled to the truck frame.

In the above configuration, preferably, each of the storage parts is disposed on at least any one surface of the one pair of side surfaces of the lower weight, and a side surface on an opposite side of the opposite surface in the front and rear direction.

With this configuration, the worker can take out the coupling pins from the storage parts and promptly reach the frame side coupling parts and the weight side coupling parts.

In the above configuration, preferably, the lower travelling body further includes a ladder installable in the upper weight, the ladder enabling the worker to move between the ground and the upper weight upper surface part.

With this configuration, the worker can move directly from the ground onto the upper weight. In other words, access from the ground to the upper weight and the one pair of side frames is better than in other weight structure in which the worker moves from the ground onto the lower weight and then moves from the lower weight to the upper weight.

The invention claimed is:

1. A construction machine, comprising:

a lower travelling body configured to move on ground; and an upper slewing body supported by the lower travelling body in a slewable manner, wherein the lower travelling body includes:

a truck frame including a front surface part and a rear surface part, the truck frame supporting the upper slewing body;

one pair of left and right side frames each supporting a crawler that allows circling movement, the one pair of left and right side frames being respectively coupled to both ends of a left and right direction of the truck frame to extend in a front and rear direction more than the truck frame; and one pair of front and rear travelling body weights respectively disposed on a front side and a rear side of the truck frame between the one pair of side frames, the truck frame includes frame side coupling parts disposed on the front surface part and the rear surface part, and coupled to the travelling body weights, each of the one pair of front and rear travelling body weights includes:

a lower weight including a lower weight upper surface part, one pair of side surfaces disposed facing the one pair of side frames, and a weight side coupling part coupled to each of the frame side coupling parts; and an upper weight including an upper weight upper surface part and disposed above the lower weight upper surface part of the lower weight, both ends of the left and right direction of the upper weight extending to project to sides of the one pair of side frames more than the one pair of side surfaces of the lower weight, the upper weight upper surface part of the upper weight forms a moving passage extending continuously along the left and right direction between the both ends of the upper weight, the moving passage allowing movement by a worker between the one pair of side frames, the one pair of front and rear travelling body weights is respectively supported by the front surface part and the rear surface part of the truck frame between the one pair of side frames, the truck frame further includes two pairs of front and rear jack up devices respectively disposed to project from the front surface part and the rear surface part at positions to sandwich the frame side coupling parts from both sides of the left and right direction, the two pairs of front and rear jack up devices being configured to support the lower travelling body, the lower weight is disposed at a position sandwiched by one pair of the jack up devices of the two pairs of front and rear jack up devices from both sides of the left and right direction, and coupling passages that enable access to the frame side coupling parts and the weight side coupling parts from front or rear of the travelling body weights are formed along the front and rear direction below the upper weight and between the one pair of side surfaces of the lower weight and the one pair of jack up devices, by disposing the one pair of side surfaces of the lower weight spaced apart from the one pair of jack up devices in the left and right direction.

2. The construction machine according to claim 1, wherein the upper weight is detachable with respect to the lower weight.

3. The construction machine according to claim 1, wherein the upper weight includes an upper weight lower surface part positioned below the upper weight upper surface part, and the construction machine further comprises a plurality of weight coupling parts that couples the upper weight to the lower weight such that the upper weight lower surface part is disposed spaced apart above the lower weight upper surface part.

4. The construction machine according to claim 3, wherein the plurality of weight coupling parts is disposed to sandwich the lower weight from both sides of the left and right direction, and each of the plurality of weight coupling parts includes:

a coupling leg disposed to project downward from the upper weight lower surface part; and a lower weight side support bracket disposed on each of the side surfaces of the lower weight and supporting the coupling leg at a position lower than the lower weight upper surface part.

5. The construction machine according to claim 3, wherein the plurality of weight coupling parts includes truck frame side support parts disposed in the truck frame and supporting the upper weight from below.

6. The construction machine according to claim 3, further comprising a plurality of inter-frame connection members connecting the truck frame to the one pair of left and right side frames, wherein the plurality of weight coupling parts includes auxiliary supports disposed in the plurality of inter-frame connection members and supporting the upper weight from below.

7. The construction machine according to claim 3, wherein the truck frame further includes a plurality of jack up devices disposed to project from the front surface part and the rear surface part at positions to sandwich the frame side coupling parts from both sides of the left and right direction, the plurality of jack up devices being configured to support the lower travelling body, and the upper weight is disposed to cover the plurality of jack up devices from above.

8. The construction machine according to claim 1, wherein first through holes are opened along the left and right direction in the frame side coupling parts, second through holes are opened along the left and right direction in the weight side coupling parts, and the lower travelling body further includes coupling pins to be inserted into the first through holes and the second through holes, the coupling pins coupling the travelling body weights and the truck frame to each other.

9. The construction machine according to claim 8, wherein the travelling body weights include storage parts configured to store the coupling pins.

10. The construction machine according to claim 9, wherein each of the storage parts is disposed on at least any one surface of the one pair of side surfaces of the lower weight and a side surface on an opposite side of the opposite surface in the front and rear direction.

11. The construction machine according to claim 1, wherein the lower travelling body further includes a ladder installable in the upper weight, the ladder enabling the worker to move between the ground and the upper weight upper surface part.

12. A construction machine, comprising:

a lower travelling body configured to move on ground; and an upper slewing body supported by the lower travelling body in a slewable manner, wherein the lower travelling body includes:

a truck frame including a front surface part and a rear surface part, the truck frame supporting the upper slewing body;

one pair of left and right side frames each supporting a crawler that allows circling movement, the one pair of left and right side frames being respectively coupled to both ends of a left and right direction of the truck frame to extend in a front and rear direction more than the truck frame; and one pair of front and rear travelling body weights respectively disposed on a front side and a rear side of the truck frame between the one pair of side frames, the truck frame includes frame side coupling parts disposed on the front surface part and the rear surface part, and coupled to the travelling body weights, each of the one pair of front and rear travelling body weights includes:

a lower weight including a lower weight upper surface part, one pair of side surfaces disposed facing the one pair of side frames, and a weight side coupling part coupled to each of the frame side coupling parts; and an upper weight including an upper weight upper surface part and disposed above the lower weight upper surface part of the lower weight, both ends of the left and right direction of the upper weight extending to project to sides of the one pair of side frames more than the one pair of side surfaces of the lower weight, the upper weight upper surface part of the upper weight forms a moving passage extending continuously along the left and right direction between the both ends of the upper weight, the moving passage allowing movement by a worker between the one pair of side frames, the upper weight is detachable with respect to the lower weight, the upper weight includes:

a plate-shaped part extending along the left and right direction and disposed above the lower weight upper surface part of the lower weight; and a plurality of legs disposed to project downward from a lower surface part of the plate-shaped part, the plurality of legs being configured to support the plate-shaped part at a predetermined height with respect to the ground by coming into contact with the ground when the upper weight is detached from the lower weight.

* * * * *